US005227139A

United States Patent [19]

Wong

[11] Patent Number: 5,227,139

[45] Date of Patent: Jul. 13, 1993

[54] SANITARY SAMPLING SYSTEM

[75] Inventor: David M. Wong, Chesterfield, Mo.

[73] Assignee: Mallinckrodt Medical, Inc., St. Louis, Mo.

[21] Appl. No.: 724,222

[22] Filed: Jul. 1, 1991

Related U.S. Application Data

[63] Continuation of Ser. No. 471,186, Jan. 26, 1990, abandoned.

[51] Int. Cl.[5] ..... B01L 11/00

[52] U.S. Cl. ..... 422/103; 422/99; 422/100; 422/102; 436/810; 435/296; 435/809; 215/363; 215/349; 215/350; 277/101; 277/184

[58] Field of Search ..... 922/99, 102, 103, 104, 922/100; 292/256.75, 256.67; 215/355, 360, 363, 340, 349, 350, 351; 128/760, 763, 764; 277/101, 116.8, 184, 121; 436/810; 435/296, 809

[56] References Cited

U.S. PATENT DOCUMENTS 2,801,764 12/1954 Russell et al. ..... 220/46
3,013,687 12/1961 Gould ..... 215/D3
3,653,528 4/1972 Wimmer ..... 215/D3
4,342,724 8/1982 Narra ..... 422/102
4,564,117 1/1986 Herbert ..... 215/329
4,893,636 1/1990 Cook et al. ..... 128/764

FOREIGN PATENT DOCUMENTS 0102851 8/1992 European Pat. Off. ..... 422/99

*Primary Examiner*—James C. Housel
*Assistant Examiner*—Long V. Le
*Attorney, Agent, or Firm*—Rita Downard Vacca

[57] ABSTRACT

A sanitary sampling system for attachment to a tube portion of a fluid containing enclosure. The sanitary sampling system is comprised of a rigid stem portion for attachment to the tube portion of the fluid enclosure, a stopper portion having a lower portion for insertion into the rigid stem portion and tube portion, a disk-shaped orifice plate fitting for placement on the upper surface of the stopper portion and an adjustable clamp for adjustment around the stem portion, orifice plate fitting and stopper portions of the sanitary sampling system. The sanitary sampling system is designed to enable the stem portion, stopper portion and orifice plate fitting to interlock to form an air-tight and leak-free seal when the adjustable clamp is tightened.

20 Claims, 2 Drawing Sheets

SANITARY SAMPLING SYSTEM

This application is a continuation application claiming priority to, application Ser. No. 471,186 filed on Jan. 26, 1990, now abandoned.

BACKGROUND OF THE INVENTION

This invention relates to a sanitary sampling system and, more particularly, to a reusable multi-portioned leak-free device for attachment to a fluid containing enclosure.

During research, development, production or similar procedures in working with specialty fluids, a sanitary means of taking aliquot samples of the fluid of interest is often necessary. Although various devices which allow aliquot sampling to be taken have heretofore been provided, none have been particularly adapted for easily repeated sanitary intrusive sample taking of a contained fluid. There is, therefore, a need for the present sanitary sampling system which particularly lends itself to ease of repeated use without loss of fluid or contamination thereof.

In general, it is an object of the present invention to provide a reusable sanitary sampling system to provide a means of taking numerous fluid samples without contaminating the fluid source and fluid sample.

Another object of the invention is to provide a sanitary sampling system of the above character which is easy and convenient to use.

Another object of the present invention is to provide a sanitary sampling system of the above character which is inexpensive and can be constructed with ease.

Additional objects and features of the present invention will appear from the following description in which the preferred embodiment is set forth in detail in conjunction with the accompanying drawings.

DETAILED DESCRIPTION OF THE INVENTION

Figure 1:
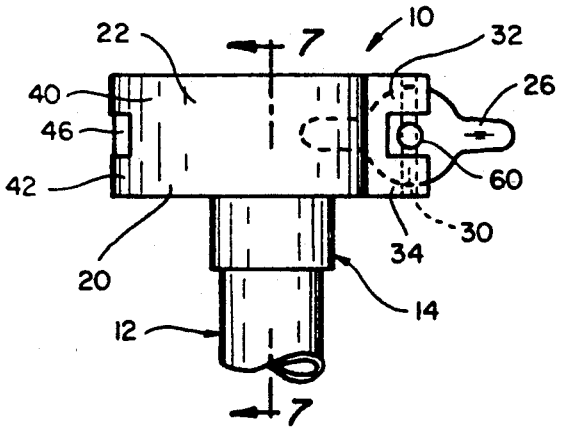
FIG. 1 is a side view of the sanitary sampling system of the present device.
Figure 2:
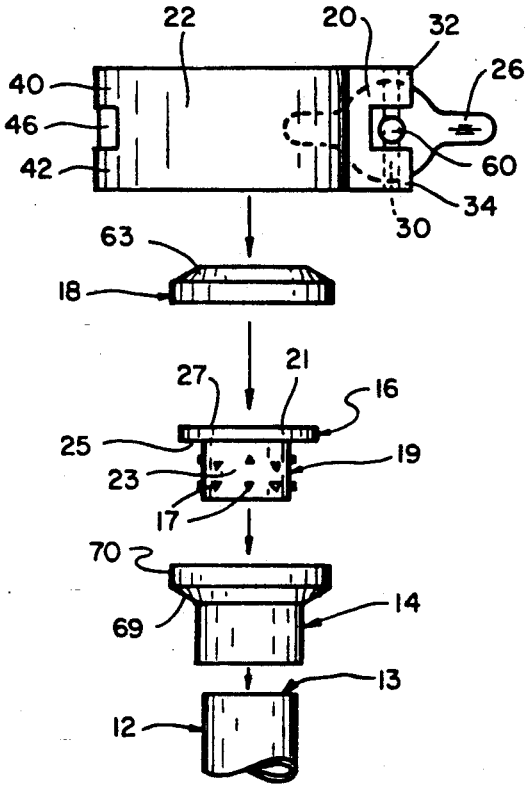
FIG. 2 is an exploded side view of the sanitary sampling system of FIG. 1.
Figure 3:
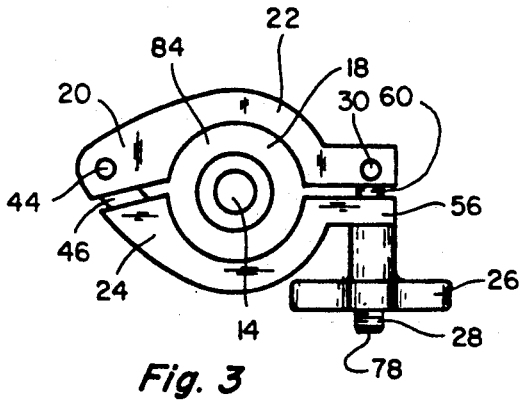
FIG. 3 is a top view of the sanitary sampling system of FIG. 1.
Figure 5:
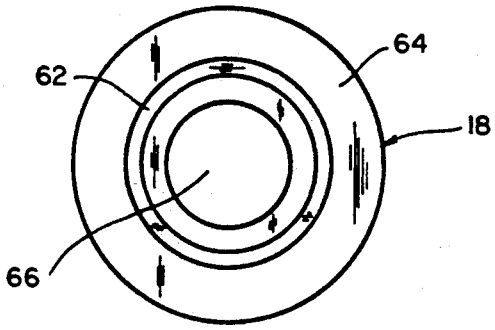
FIG. 5 is a bottom view of the orifice plate fitting portion of the sanitary sampling system of FIG. 1.
Figure 6:
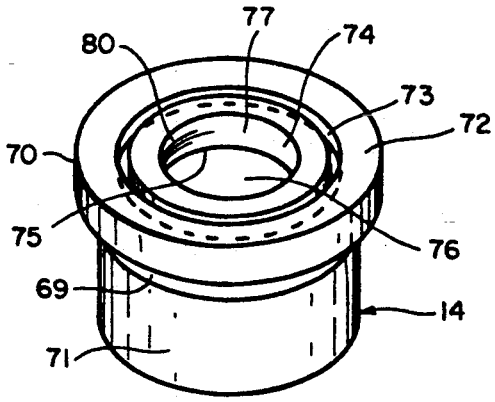
FIG. 6 is a side perspective view of the stem portion of the sanitary sampling system of FIG. 1.
Figure 7:
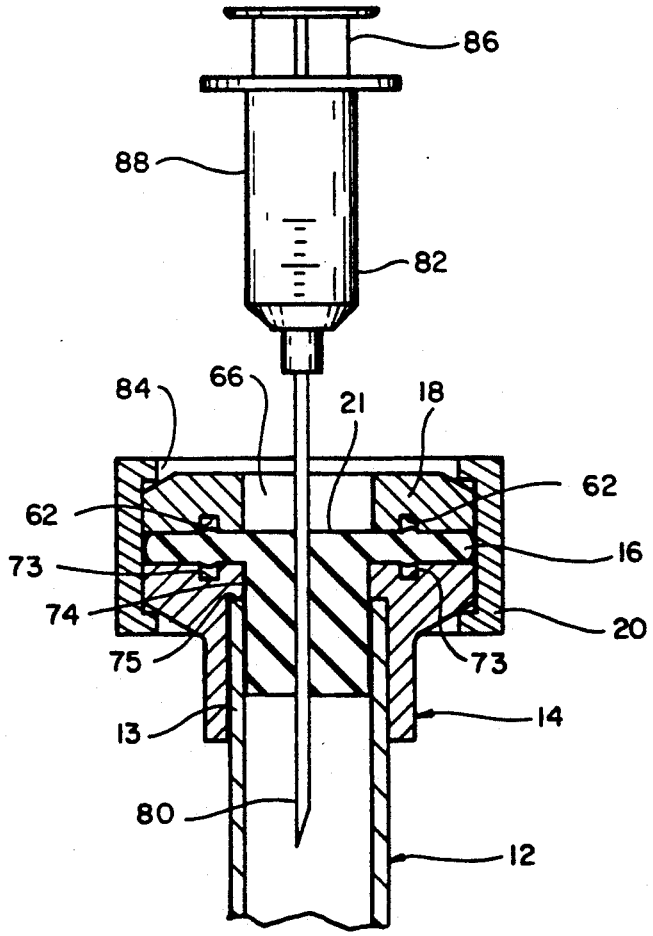
FIG. 7 is a cross sectional view of the sanitary sampling system of FIG. 1 passing through line 7—7 with a syringe device inserted therethrough.

In FIGS. 1-7, a preferred embodiment of a sanitary sampling system 10 made in accordance with the teachings of the present invention is shown. As best illustrated in FIGS. 1, 2 and 7, the present invention comprises four essential portions; the stem portion 14, stopper portion 16, orifice plate fitting 18 and clamp 20, which when assembled form an air tight and sanitary seal with the free end 13 of a tube 12 so as to be in direct fluid communication with a fluid containing enclosure (not pictured).

In assembling the subject device on must first have a tube 12 which is connected and in fluid communication with a fluid enclosure (not pictured). The free end 13 of tube 12 is of a standardized size which enables stem portion 14 to be slipped thereon and may be held in position by friction fit or by an adhesive.

Stem portion 14 is substantially tubular in shape having an outwardly extending area 69 which ultimately forms an upper ridge 70 having a larger diameter than that of the lower portion 71 just below extending are 69. As illustrated in FIG. 6, the upper surface 72 of stem portion 14 has a channel 73 which extends there around an equidistance from opening 77. The interior edge 74 of upper surface 72 extends inwardly whereby opening 77 has a smaller diameter than that of the stem interior surface 76. This forms a seat member 75 as shown in FIG. 7 which when stem portion 14 is attached to tube 12 causes free end 13 of tube 12 to abut seat member 75 to ensure a tight seal.

Stopper portion 16 is designed to fit securely within stem portion 14 and tube 12. The stopper portion 16 has a lower tail portion 19 which is cylindrical in shape and has a disk-shaped head portion 21 integrally formed therewith. On the exterior surface 23 of tail portion 19 are various wedge-shaped bumps 17 which prevent any slippage of stopper portion 16 from within stem portion 14. Likewise, channel 73 on upper surface 72 of stem portion 14 is in direct contact with lower surface 25 of head portion 21 to prevent movement of or fluid leakage around stopper portion 16 which is discussed in more detail below.

Positioned on the top surface 27 of head portion 21 of stopper member 16 is orifice plate fitting 18. As illustrated in FIGS. 5 and 6, orifice plate fitting 18 is substantially disk-shaped with a slightly upwardly sloped upper surface 63 and an opening 66 which extends through the center thereof. On the lower surface 64 of orifice plate fitting 18 is a channel 62 which, like channel 73, prevents movement of stopper portion 16 and prevents fluid leakage when fully assembled.

Figure 4:
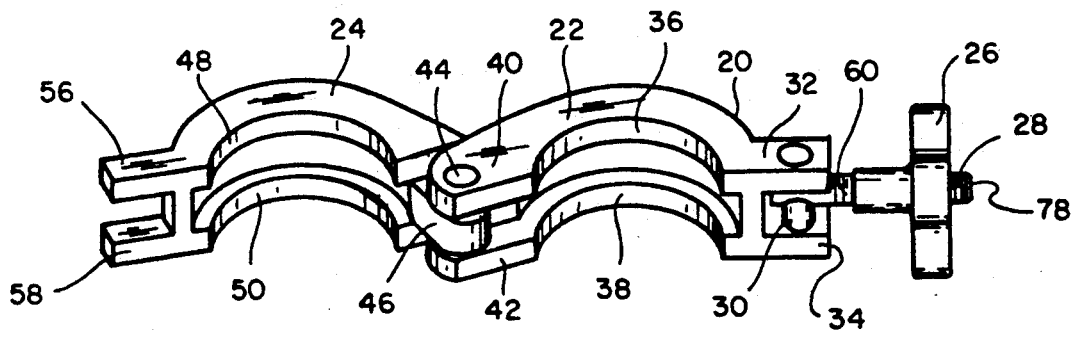
FIG. 4 is a side perspective view of the clamp portion of the sanitary sampling system of FIG. 1.

Holding stem portion 14, stopper portion 16 and orifice plate fitting 18 in tight sealed communication is clamp 20 shown in detail in FIG. 4. Clamp 20 is a 360° clamp having two portions, a major arm portion 22 and a minor arm portion 24. Major arm portion 22 has a rod means 60 fixed by means of a pin 30 between an extended upper extension means 32 and an extended lower extension means 34. The free end 78 of rod means 60 has threaded engagement means 28 and a wing nut handle 26 which engages therewith. Major arm portion 22 likewise has an extended upper extension means 40 and an extended lower extension means 42 opposite extension means 32 and 34. Major arm portion 22 has an 180° curve as does minor arm portion 24. Minor arm portion 24 additionally has a mid extender 46 which fits between upper extension means 40 and lower extension means 42 of major arm portion 22 which serves as a hinge when pinned there between by pin member 44. Opposite mid extender 46 of minor arm portion 24 is upper extension 56 and lower extension 58. Rod member 60 may be positioned between upper and lower extensions 56 and 58 respectively. When rod member 60 is so positioned, wing handle 26 is capable of being tightened by means of threaded engagement means 28 thereby locking clamp 20 around stem portion 14, stopper portion 16 and orifice plate fitting 18. When clamp 20 is so positioned, upper edge 36 of major arm portion 22 and upper extending edge 48 of minor arm portion 24 overlap a portion of upper surface 63 of orifice plate fitting 18. Likewise, lower edge 38 of major arm portion 22 and lower extending edge 50 of minor arm portion 24 overlap a portion of outwardly extending area 69 of stem portion 14.

Once clamp 20 is securely tightened around the other three portions of the device head portion 21 of stopper 16 is compressed between stem portion 14 and orifice plate fitting 18. However, stopper portion 16 is constructed of a resilient material such that in the area of channel 73 and channel 62, head portion 21 is not compressed and thereby extends into channel 73 and channel 62 to interlock therewith as illustrated in FIG. 7. A strong air-tight seal is created by this interlocking action preventing any fluid communcation between the inside and outside of pipe 12. This prevents contaminants from entering the fluid within tube 12 as well as preventing any leakage.

Once assembled, sanitary samples may then be collected by piercing a needle portion 80 of a syringe 82 through upper opening 84 in clamp 20, through opening 66 in orifice plate fitting 18 and piercing through stopper 16 so as to be in direct communication with the fluid in the interior of pipe 12. A sample may then be extracted from pipe 12 by pulling plunger 86 outwardly from within the syringe housing 88 and then removing the needle portion 80 from within the stopper 16 as well as the sampling system. This process may be repeated numerous times without leakage or contamination of the sample.

The stopper portion 16 of the preferred embodiment may be constructed from a resilient synthetic material or natural rubber. The remaining portions of the sanitary sampling system according to the present invention may be constructed from rigid synthetic material, metal, wood or any combination of other similar rigid materials.

The dimensions of the present invention will be standardized so as to be compatible with a variety of standard sized tubes.

The foregoing been a description of the preferred embodiment of the present invention. Although many specific details have been described, it should be understood that the description is only for the purposes of explaining the invention and not limiting it. It should be further understood that the configuration of the sanitary sampling system proposed herein is not limited in any way except by the limitations contained in the claims which follow.

What is claimed is:

1. A sanitary sampling system for attachment to a tube portion of a fluid containing enclosure comprising: a rigid stem portion for attachment to said tube portion of said fluid enclosure; a stopper portion having a lower portion for insertion into said rigid stem portion and said tube portion and having a flattened head portion of which a lower surface thereof abuts a flattened free extended edge of said rigid stem portion when a tail portion thereof is inserted into said rigid stem portion; a disk-shaped orifice plate fitting for placement on an upper surface of said flattened head portion of said stopper portion; an adjustable clamp for fitting snugly around said stem portion, said stopper portion and said orifice plate fitting; and an annular channel located in an upper surface of said flattened free extended edge of said rigid stem portion and in a lower flattened surface of said orifice plate fitting so as to allow both annular channels to be in direct contact with said stopper portion which allows said stopper portion to extend into said channels when said adjustable clamp is tightened to form an air-tight and leak-free seal.

2. A sanitary sampling system according to claim 1, wherein said stopper portion is constructed of a material selected from the group consisting of a resilient synthetic monomer, a resilient synthetic polymer and natural rubber.

3. A sanitary sampling system according to claim 1, wherein said stem portion, said orifice plate fitting and said adjustable clamp are constructed of a material independently selected from the group consisting of a rigid synthetic monomer, a rigid synthetic polymer, metal and wood.

4. A sanitary sampling system according to claim 1, wherein said stem portion, said stopper portion, said orifice plate fitting, and said adjustable clamp have a substantially cylindrical form when assembled.

5. A sanitary sampling system according to claim 1, wherein said stopper portion is designed to be puncturable by a needle to withdraw samples and to reseal upon withdrawal of said needle.

6. A method of assembling a sanitary sampling system onto a tube portion of a fluid containing enclosure comprising:

a) positioning a stem portion of said sampling system over a free end of said tube portion of said fluid enclosure;

b) inserting a stopper portion of said sampling system partially into said stem portion and said tube portion surrounded by said stem portion;

c) placing an orifice plate fitting on a flattened exposed surface of said stopper portion;

d) placing an adjustable ring clamp around said stem portion, stopper portion and orifice plate fitting; and e) tightening said adjustable ring clamp, whereby said stem portion, stopper portion and orifice plate fitting interlock to form an air-tight and leak-free seal wherein a first annular channel is formed in said stem portion and a second annular channel is formed in said orifice plate fitting, such that when said stem portion and said orifice plate fitting are assembled in direct contact extends therein upon tightening of said adjustable ring clamp in order to form an air-tight and leak-free seal.

7. A method of assembling a sanitary sampling system according to claim 6, wherein said stopper portion is constructed of a material selected from the group consisting of a resilient synthetic monomer, a resilient synthetic polymer and natural rubber.

8. A method of assembling a sanitary sampling system according to claim 6, wherein said stem portion, said orifice plate fitting and said adjustable ring clamp are constructed of a material independently selected from the group consisting of rigid synthetic monomers, rigid synthetic polymers, metal and wood.

9. A method of assembling a sanitary sampling system according to claim 7, wherein said stem portion, said stopper portion, said orifice plate fitting and said adjustable ring clamp have a substantially cylindrical form when assembled.

10. A method of assembling a sanitary sampling system according to claim 6, wherein said stopper portion is designed to be puncturable by a needle for the withdrawal of samples and to reseal upon withdrawal of said needle.

11. A sanitary sampling system for attachment to a fluid containing enclosure comprising:

a rigid first portion for attachment to a tube portion of said fluid enclosure;

a resilient second portion for partial insertion into said first portion and said tube portion; a rigid thin portion having an opening in the center thereof and designed for placement on an exposed flat surface of said resilient second portion;

a rigid adjustable clamp for attachment around the periphery of said first, second and third portions and being tightenable to interlock said first, second, and third portions to form an air-tight and leak-free seal; and a first annular channel formed in said rigid first portion and a second annular channel formed in said rigid third portion, said first and second annular channels being in direct contact with said resilient second portion and allowing said resilient second portion to extend there into when said rigid adjustable clamp is tightened in order to form an air-tight and leak-free seal;

whereby a needle portion of a syringe may be used to repeatedly puncture an exposed area of said resilient second portion to withdraw fluid samples from within said fluid containing enclosure.

12. A sanitary sampling system according to claim 11, wherein said resilient second portion is constructed from a material selected from the group consisting of synthetic monomers, synthetic polymers and natural rubber.

13. A sanitary sampling system according to claim 11, wherein said rigid first portion, rigid third portion, and rigid adjustable clamp are constructed from a material independently selected from the group consisting of synthetic monomers, synthetic polymers, metal and wood.

14. A sanitary sampling system according to claim 11, wherein said rigid first portion, said resilient second portion, said rigid third portion and said rigid adjustable clamp have a cylindrical form when assembled.

15. A sanitary sampling system according to claim 11, wherein said resilient second portion is designed to be repeatedly punctureable by said needle portion of said syringe and self-sealable upon withdrawal of said needle portion.

16. A method of taking sanitary fluid samples from a fluid containing enclosure comprising:

a) positioning a rigid tubular stem member having an outwardly extending flange area onto a free end of a fluid containing tube portion of said fluid enclosure;

b) inserting a resilient stopper member partially into said stem member and into said fluid portion of said stopper member to abut said outwardly extending flange area;

c) placing a rigid orifice plate member on said extended flattened portion of said stopper member opposite said outwardly extending flange area so as to position an opening in said orifice plate member over the middle of said extended flattened portion;

d) placing an adjustable ring clamp around said stem member, stopper member and orifice plate member;

e) tightening said adjustable ring clamp so as to cause said stem member, stopper member and orifice plate member to interlock and form an air-tight and leak-free seal;

f) puncturing said stopper member with a needle portion of a syringe and withdrawing a sample of fluid from said fluid containing tube; and g) withdrawing said needle portion from said stopper member, wherein a first annular channel is formed in said stem member, a second annular channel is formed in said orifice plate member, said first and second annular channels being in direct contact with said stopper member and allowing said stopper member to extend there into when said rigid adjustable clamp is tightened in order to form an air-tight and leak-free seal.

17. A method according to claim 16, wherein said stopper member is constructed of a material selected from the group consisting of a resilient synthetic monomer, a resilient synthetic polymer and natural rubber.

18. A method according to claim 16, wherein said stem member, orifice plate member and adjustable ring clamp are constructed from a material independently selected from the group consisting of a rigid synthetic monomer, a rigid synthetic polymer, metal and wood.

19. A method according to claim 16, wherein said stem member, stopper member, orifice plate member and adjustable ring clamp have a substantially cylindrical form when assembled.

20. A method according to claim 16, wherein said stopper member is designed to be repeatedly puncturable by said needle and to self-seal upon withdrawal of said needle.

* * * * *

UNITED STATES PATENT AND TRADEMARK OFFICE

CERTIFICATE OF CORRECTION

PATENT NO. : 5,227,139

DATED : July 13, 1993

INVENTOR(S) : David Wong

It is certified that error appears in the above-identified patent and that said Letters Patent is hereby corrected as shown below:

Column 2, line 1,
"on" should be --one--;

Column 2, line 10,
"are" should be --area--;

Column 4, line 44,
after "contact" should insert --with said stopper portion, said stopper portion--.

Signed and Sealed this

Fourteenth Day of June, 1994

Bruce Lehman

*Attest:*

BRUCE LEHMAN

*Attesting Officer*

*Commissioner of Patents and Trademarks*